US009119237B2

(12) United States Patent
Hu et al.

(10) Patent No.: US 9,119,237 B2
(45) Date of Patent: Aug. 25, 2015

(54) LIGHTING LAMP

(71) Applicant: National Taiwan University of Science and Technology, Taipei (TW)

(72) Inventors: Neng-chung Hu, Taipei (TW); Chin-chuan Wu, Taipei (TW); Wei-zhen Wu, Taipei (TW)

(73) Assignee: NATIONAL TAIWAN UNIVERSITY OF SCIENCE AND TECHNOLOGY, Taipei (TW)

( * ) Notice: Subject to any disclaimer, the term of this patent is extended or adjusted under 35 U.S.C. 154(b) by 524 days.

(21) Appl. No.: 13/684,299

(22) Filed: Nov. 23, 2012

(65) Prior Publication Data

US 2014/0049178 A1 Feb. 20, 2014

(30) Foreign Application Priority Data

Aug. 15, 2012 (TW) ..... 101215731 A

(51) Int. Cl.
*H05B 39/04* (2006.01)
*H05B 37/02* (2006.01)
*H05B 33/08* (2006.01)

(52) U.S. Cl.
CPC ..... *H05B 37/02* (2013.01); *H05B 33/0857* (2013.01)

(58) Field of Classification Search
CPC .. G02B 6/0028; G02B 6/0068; G02B 6/0018; F21K 9/56; F21K 9/00; F21K 9/135; F21K 9/50; F21K 9/54; F21K 9/10; F21K 9/13; F21K 9/52; F21K 99/00; F21K 9/17; F21K 9/175; F21V 13/02; F21V 9/16
USPC ..... 315/152, 294, 151, 153, 158, 210, 297, 315/312, 51
See application file for complete search history.

(56) References Cited

U.S. PATENT DOCUMENTS

2002/0125804 A1* 9/2002 McGuire et al. ..... 313/112
2004/0105264 A1* 6/2004 Spero ..... 362/276
2012/0206050 A1* 8/2012 Spero ..... 315/152

OTHER PUBLICATIONS

Neng-Chung Hu; Chin-Chuan Wu; and Wei-Zhen Wu, The study of Rebuild the Black-body Radiation by the Best CRI Method with Multi-chip LED Module, Thesis, Jul. 11, 2012.

* cited by examiner

*Primary Examiner* — Douglas W Owens
*Assistant Examiner* — Monica C King
(74) *Attorney, Agent, or Firm* — Lowe Hauptman & Ham, LLP

(57) ABSTRACT

The present invention discloses a lighting lamp (10), is used for emitting a plurality of lights with different color temperatures, and color rendering indexes of all the lights are larger than 90. The lighting lamp (10) includes a combination (100) of light sources and a driving module (200). The combination (100) of the light sources includes four LEDs with specific wavelengths. The driving module (200) is utilized to drive the LEDs to illuminate and to control energy distribution of luminous energy for the first, second, third and fourth LEDs, thereby dynamically adjusting to show the light with 9000K, 12000K and eight color temperatures defined by the ENERGY STAR.

14 Claims, 1 Drawing Sheet

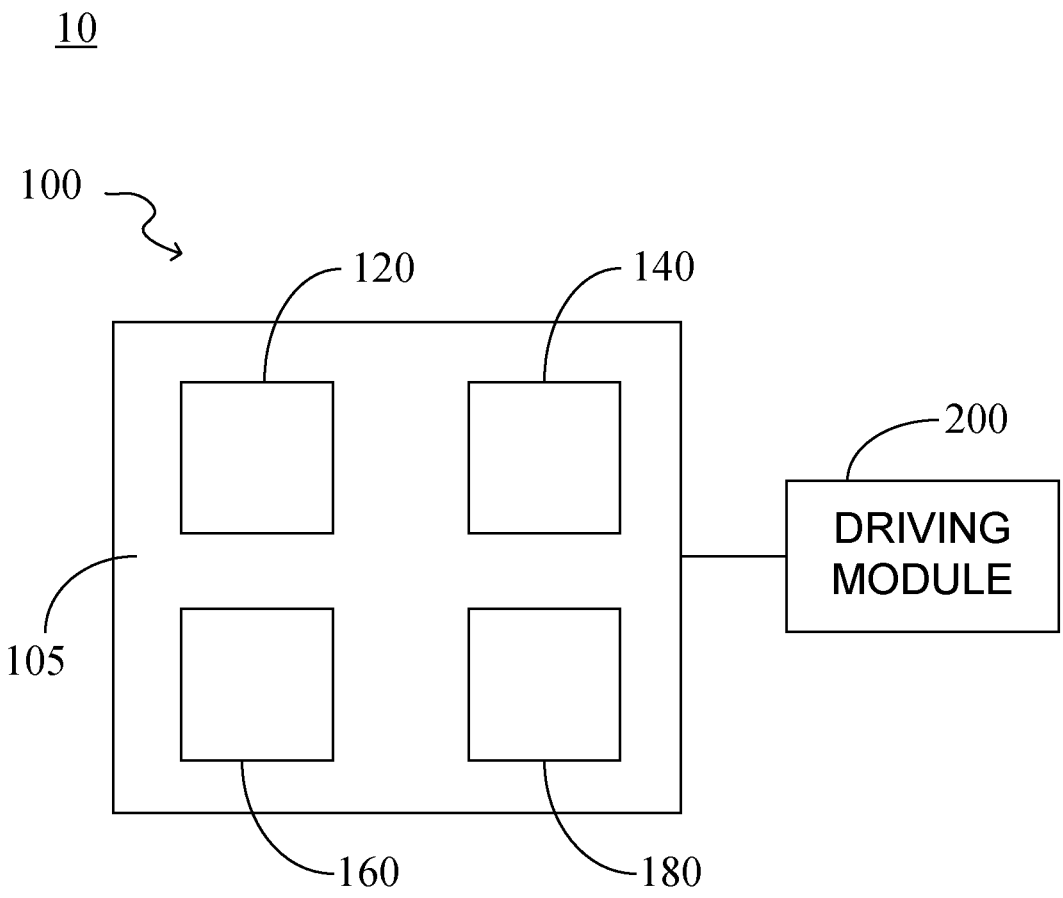
10
100
120
140
200
DRIVING MODULE
105
160
180

LIGHTING LAMP

CROSS-REFERENCE

This application claims the priority of Taiwan Patent Application No. 101215731, filed on Aug. 15, 2012 in the Taiwan Intellectual Property Office (TIPO), the disclosure of which is incorporated herein in their entirety by reference. This invention is partly disclosed in a thesis entitled "The study of Rebuild the Black-body Radiation by the Best CRI Method with Multi-chip LED Module" on Jul. 11, 2012 completed by Wei-zhen Wu.

TECHNICAL FIELD OF THE INVENTION

The present invention relates to an illuminating lamp, and especially to an ENERGY STAR qualified lighting lamp.

BACKGROUND OF THE INVENTION

ENERGY STAR is an international standard for energy efficient consumer products originated in the United States of America. The ENERGY STAR is awarded to lighting products that meet some criteria. The criteria is that illuminating light with eight color temperatures (CT) (2700K, 3000K, 3500K, 4000K, 4500K, 5000K, 5700K, and 6500K) defined by blackbody radiation, and a color rendering index (CRI) of each of the illuminating light is larger than 80. Light colors of traditional light-emitting diode (LED) lighting lamp can be divided into three types: cold white (CT=6500K), warm white (CT=2800K) and white (CT=4000K), and the light colors are generally fixed and unadjustable.

In order to achieve the adjustment of the light colors, the color mixing technology in general is given by mixing light sources of red, green and blue LEDs, and controlling individual luminous intensities of the red, green and blue LEDs to change different colors or color temperatures as desired. However, because each LED has an individual peak wavelength of the color thereof; a spectrum of the light mixed only from the red, green and blue LEDs is not continuous and full spectrum; Accordingly, the color rendering index (CRI) thereof can not be improved.

Thus, there are many techniques that a variety of LEDs are utilized to mix for achieving a high CRI at present. For example, red, amber, blue and green LEDs are used for the color mixing and the light of the LEDs are modulated to the illuminating light with various color temperatures. However, the color rendering indexes of commercial adjustable lighting lamps can not completely meet the criteria of the ENERGY STAR when the lighting lamps are modulated to the above-mentioned color temperatures. That is, the color rendering indexes can reach above 80 only under some color temperatures.

Moreover, in order to reach high color rendering indexes, the lighting lamps that use a plurality of LEDs (more than four LEDs) for the color mixing have been proposed at present, but costs thereof are highly increased. In addition, in the plurality of LEDs, there are some phosphors-doped LEDs, which have a drawback of deterioration easily. Once the phosphors-doped LEDs deteriorate, the whole lighting lamp will generate a serious color shift.

Therefore, the problem that how to create an ENERGY STAR qualified lighting lamp capable of modulating various color temperatures and having a high CRI is actively disclosed in the present invention.

SUMMARY OF THE INVENTION

Accordingly, an objective of the present invention is to provide an ENERGY STAR lighting lamp, which only adopts four LEDs having specific wavelengths. Illuminating lights with 10 different color temperatures (2700K, 3000K, 3500K, 4000K, 4500K, 5000K, 5700K, 6500K, 9000K, and 12000K) can be modulated, and the CRI of the illuminating light of each color temperature can reach above 90, thereby achieving cost savings and good lighting effects.

To achieve the foregoing objectives, the lighting lamp provided in the present invention is used for emitting a plurality of lights with different color temperatures. The lighting lamp includes a combination of light sources and a driving module. The combination of the light sources consist essentially of: a first LED whose main wavelength ranges from 447 nanometers to 463 nanometers; a second LED whose main wavelength ranges from 520 nanometers to 540 nanometers; a third LED whose main wavelength ranges from 588 nanometers to 605 nanometers; and a fourth LED whose main wavelength ranges from 623 nanometers to 670 nanometers. The driving module is electrically coupled to the combination of the light sources for driving the LEDs to illuminate and controlling energy distribution of luminous energy for the first, second, third and fourth LEDs. The color rendering indexes of the lights emitted from the lighting lamp are larger than 90.

Specifically, the color temperature comprises 2700K, 3000K, 3500K, 4000K, 4500K, 5000K, 5700K, 6500K, 9000K, and 12000K. Moreover, the energy distribution of the luminous energy for the first LED that emits the above-mentioned 10 color temperatures ranges from 0.061 to 1; the energy distribution of the luminous energy for the second LED ranges from 0.124 to 1; the energy distribution of the luminous energy for the third LED ranges from 0.220 to 1; the energy distribution of the luminous energy for the fourth LED ranges from 0.178 to 1.

In one preferred embodiment, while the light with color temperature of 2700K is emitted, the energy distribution of the luminous energy for the first LED ranges from 0.061 to 0.435; the energy distribution of the luminous energy for the second LED ranges from 0.124 to 0.925; the energy distribution of the luminous energy for the third LED ranges from 0.220 to 1; the energy distribution of the luminous energy for the fourth LED ranges from 0.755 to 1.

In one preferred embodiment, while the light with color temperature of 3000K is emitted, the energy distribution of the luminous energy for the first LED ranges from 0.087 to 0.569; the energy distribution of the luminous energy for the second LED ranges from 0.144 to 1; the energy distribution of the luminous energy for the third LED ranges from 0.229 to 1; the energy distribution of the luminous energy for the fourth LED ranges from 0.672 to 1.

In one preferred embodiment, while the light with color temperature of 3500K is emitted, the energy distribution of the luminous energy for the first LED ranges from 0.076 to 0.799; the energy distribution of the luminous energy for the second LED ranges from 0.132 to 1; the energy distribution of the luminous energy for the third LED ranges from 0.229 to 1; the energy distribution of the luminous energy for the fourth LED ranges from 0.560 to 1.

In one preferred embodiment, while the light with color temperature of 4000K is emitted, the energy distribution of the luminous energy for the first LED ranges from 0.193 to 0.977; the energy distribution of the luminous energy for the second LED ranges from 0.212 to 1; the energy distribution of the luminous energy for the third LED ranges from 0.252 to 1; the energy distribution of the luminous energy for the fourth LED ranges from 0.488 to 1.

In one preferred embodiment, while the light with color temperature of 4500K is emitted, the energy distribution of the luminous energy for the first LED ranges from 0.253 to 1;

the energy distribution of the luminous energy for the second LED ranges from 0.244 to 1; the energy distribution of the luminous energy for the third LED ranges from 0.263 to 1; the energy distribution of the luminous energy for the fourth LED ranges from 0.424 to 1.

In one preferred embodiment, while the light with color temperature of 5000K is emitted, the energy distribution of the luminous energy for the first LED ranges from 0.314 to 1; the energy distribution of the luminous energy for the second LED ranges from 0.267 to 1; the energy distribution of the luminous energy for the third LED ranges from 0.268 to 1; the energy distribution of the luminous energy for the fourth LED ranges from 0.391 to 1.

In one preferred embodiment, while the light with color temperature of 5700K is emitted, the energy distribution of the luminous energy for the first LED ranges from 0.384 to 1; the energy distribution of the luminous energy for the second LED ranges from 0.306 to 1; the energy distribution of the luminous energy for the third LED ranges from 0.279 to 0.949; the energy distribution of the luminous energy for the fourth LED ranges from 0.356 to 1.

In one preferred embodiment, while the light with color temperature of 6500K is emitted, the energy distribution of the luminous energy for the first LED ranges from 0.459 to 1; the energy distribution of the luminous energy for the second LED ranges from 0.333 to 1; the energy distribution of the luminous energy for the third LED ranges from 0.284 to 0.885; the energy distribution of the luminous energy for the fourth LED ranges from 0.313 to 1.

In one preferred embodiment, while the light with color temperature of 9000K is emitted, the energy distribution of the luminous energy for the first LED ranges from 0.693 to 1; the energy distribution of the luminous energy for the second LED ranges from 0.434 to 0.888; the energy distribution of the luminous energy for the third LED ranges from 0.263 to 0.644; the energy distribution of the luminous energy for the fourth LED ranges from 0.205 to 1.

In one preferred embodiment, while the light with color temperature of 12000K is emitted, the energy distribution of the luminous energy for the first LED ranges from 0.759 to 1; the energy distribution of the luminous energy for the second LED ranges from 0.455 to 0.828; the energy distribution of the luminous energy for the third LED ranges from 0.239 to 0.579; the energy distribution of the luminous energy for the fourth LED ranges from 0.178 to 1.

In one preferred embodiment, the driving module is a micro processor, and the micro processor synchronously outputs four pulse width modulation signals to the LEDs, respectively.

In accordance with the preferred embodiment of the present invention, the criteria of the color temperatures can be achieved by using the four LEDs with the specific wavelengths. In addition, the eight light colors defined by the ENERGY STAR can be dynamically adjusted to show through the driving module controlling the energy proportions of the above-mentioned four LEDs, and the CRI of each light is larger than 90. Besides, the illuminating light emitted from the lighting lamp of the present invention can be modulated to the high color temperatures of 9000K and 12000K. The two illuminating lights with the high color temperatures of 9000K and 12000K have functions of improving attention and alertness, and the lights can boost user's asleep spirit in the afternoon.

It is to be understood that both the foregoing general description and the following detailed description of the present invention are exemplary and explanatory and are intended to provide further explanation of the invention as claimed.

BRIEF DESCRIPTION OF THE DRAWINGS

FIG. 1 depicts a schematic drawing illustrating an ENERGY STAR lighting lamp according to a preferred embodiment of the present invention.

DETAILED DESCRIPTION OF THE INVENTION

The following will explain an ENERGY STAR lighting lamp according to a preferred embodiment of the present invention in detail with a drawing. Referring to FIG. 1, FIG. 1 depicts a schematic drawing illustrating an ENERGY STAR lighting lamp according to a preferred embodiment of the present invention. The ENERGY STAR lighting lamp 1 of the ENERGY STAR lighting lamp 10 includes a combination 100 of light sources and a driving module 200. The combination of the light sources 100 includes a first LED 120, a second LED 140, a third LED 160, and a fourth LED 180. Preferably, the first LED 120, the second LED 140, the third LED 160, and the fourth LED 180 are closely stamped on a same circuit board 150, thereby reach a better optical mixing effect. It is worth mentioning that the arrangement of the above-mentioned four LEDs is not limited in the present invention.

In the preferred embodiment, the fourth LED 120 whose main wavelength (peak) ranges from 447 nanometers to 463 nanometers; the second LED 140 whose main wavelength ranges from 520 nanometers to 540 nanometers; the third LED 160 whose main wavelength ranges from 588 nanometers to 605 nanometers; and the fourth LED 180 whose main wavelength ranges from 623 nanometers to 670 nanometers. Accordingly, the four LEDs are all monochromatic LEDs without doping phosphors, so that the durability can be improved.

As shown in FIG. 1, The driving module 200 is electrically coupled to the combination 100 of the light sources. Specifically, the driving module 200 is respectively electrically coupled to the first LED 120, the second LED 140, the third LED 160, and the fourth LED 180. The driving module 200 is utilized to drive the LEDs to illuminate and to control proportions of luminous energy of the first LED 120, the second LED 140, the third LED 160 and the fourth LED 180 for emitting the lights with the color temperatures. Specifically, the driving module 200 can be a micro processor, and the micro processor can synchronously output four pulse width modulation (PWM) signals to the LEDs, respectively, thereby adjusting and controlling the proportions of the luminous energy of the first LED 120, the second LED 140, the third LED 160 and the fourth LED 180.

In the preferred embodiment, the LEDs can emit the lights with the eight color temperatures, i.e. 2700K, 3000K, 3500K, 4000K, 4500K, 5000K, 5700K, and 6500K that met the criteria of the ENERGY STAR. Moreover, the ENERGY STAR lighting lamp 10 can further emit two lights with two high color temperatures of 9000K and 12000K, and both the color rendering indexes of the two lights can reach 90. As to the four LEDs with the specific wavelengths, the energy distribution of the luminous energy for the first LED 120 that emits the above-mentioned 10 color temperatures ranges from 0.061 to 1; the energy distribution of the luminous energy for the second LED 140 ranges from 0.124 to 1; the energy distribution of the luminous energy for the third LED 160 ranges from 0.220 to 1; the energy distribution of the luminous energy for the fourth LED 180 ranges from 0.178 to 1.

The desired proportions of the luminous energy of the above-mentioned four LEDs that emit each of the color temperatures are respectively described as following.

While the light with color temperature of 2700K is emitted, the driving module 200 controls the desired proportions the luminous energy of the above-mentioned four LEDs as follow: the energy distribution of the luminous energy for the first LED 120 ranges from 0.061 to 0.435; the energy distribution of the luminous energy for the second LED 140 ranges from 0.124 to 0.925; the energy distribution of the luminous energy for the third LED 160 ranges from 0.220 to 1; the energy distribution of the luminous energy for the fourth LED 180 ranges from 0.755 to 1.

Similarly, while the light with color temperature of 3000K is emitted, the driving module 200 controls the desired proportions the luminous energy of the above-mentioned four LEDs as follow: the energy distribution of the luminous energy for the first LED 120 ranges from 0.087 to 0.569; the energy distribution of the luminous energy for the second LED 140 ranges from 0.144 to 1; the energy distribution of the luminous energy for the third LED 160 ranges from 0.229 to 1; the energy distribution of the luminous energy for the fourth LED 180 ranges from 0.672 to 1.

Similarly, while the light with color temperature of 3500K is emitted, the driving module 200 controls the desired proportions the luminous energy of the above-mentioned four LEDs as follow: the energy distribution of the luminous energy for the first LED 120 ranges from 0.076 to 0.799; the energy distribution of the luminous energy for the second LED 140 ranges from 0.132 to 1; the energy distribution of the luminous energy for the third LED 160 ranges from 0.229 to 1; the energy distribution of the luminous energy for the fourth LED 180 ranges from 0.560 to 1.

Similarly, While the light with color temperature of 4000K is emitted, the driving module 200 controls the desired proportions the luminous energy of the above-mentioned four LEDs as follow: the energy distribution of the luminous energy for the first LED 120 ranges from 0.193 to 0.977; the energy distribution of the luminous energy for the second LED 140 ranges from 0.212 to 1; the energy distribution of the luminous energy for the third LED 160 ranges from 0.252 to 1; the energy distribution of the luminous energy for the fourth LED 180 ranges from 0.488 to 1.

Similarly, while the light with color temperature of 4500K is emitted, the driving module 200 controls the desired proportions the luminous energy of the above-mentioned four LEDs as follow: the energy distribution of the luminous energy for the first LED 120 ranges from 0.253 to 1; the energy distribution of the luminous energy for the second LED 140 ranges from 0.244 to 1; the energy distribution of the luminous energy for the third LED 160 ranges from 0.263 to 1; the energy distribution of the luminous energy for the fourth LED 180 ranges from 0.424 to 1.

Similarly, while the light with color temperature of 5000K is emitted, the driving module 200 controls the desired proportions the luminous energy of the above-mentioned four LEDs as follow: the energy distribution of the luminous energy for the first LED 120 ranges from 0.314 to 1; the energy distribution of the luminous energy for the second LED 140 ranges from 0.267 to 1; the energy distribution of the luminous energy for the third LED 160 ranges from 0.268 to 1; the energy distribution of the luminous energy for the fourth LED 180 ranges from 0.391 to 1.

Similarly, while the light with color temperature of 5700K is emitted, the driving module 200 controls the desired proportions the luminous energy of the above-mentioned four LEDs as follow: the energy distribution of the luminous energy for the first LED 120 ranges from 0.384 to 1; the energy distribution of the luminous energy for the second LED 140 ranges from 0.306 to 1; the energy distribution of the luminous energy for the third LED 160 ranges from 0.279 to 0.949; the energy distribution of the luminous energy for the fourth LED 180 ranges from 0.356 to 1.

Similarly, while the light with color temperature of 6500K is emitted, the driving module 200 controls the desired proportions the luminous energy of the above-mentioned four LEDs as follow: the energy distribution of the luminous energy for the first LED 120 ranges from 0.459 to 1; the energy distribution of the luminous energy for the second LED 140 ranges from 0.333 to 1; the energy distribution of the luminous energy for the third LED 160 ranges from 0.284 to 0.885; the energy distribution of the luminous energy for the fourth LED 180 ranges from 0.313 to 1.

Similarly, while the light with color temperature of 9000K is emitted, the driving module 200 controls the desired proportions the luminous energy of the above-mentioned four LEDs as follow: the energy distribution of the luminous energy for the first LED 120 ranges from 0.693 to 1; the energy distribution of the luminous energy for the second LED 140 ranges from 0.434 to 0.888; the energy distribution of the luminous energy for the third LED 160 ranges from 0.263 to 0.644; the energy distribution of the luminous energy for the fourth LED 180 ranges from 0.205 to 1.

Similarly, while the light with color temperature of 12000K is emitted, the driving module 200 controls the desired proportions the luminous energy of the above-mentioned four LEDs as follow: the energy distribution of the luminous energy for the first LED 120 ranges from 0.759 to 1; the energy distribution of the luminous energy for the second LED 140 ranges from 0.455 to 0.828; the energy distribution of the luminous energy for the third LED 160 ranges from 0.239 to 0.579; the energy distribution of the luminous energy for the fourth LED 180 ranges from 0.178 to 1.

Taking the color temperature of 2700K for example, the driving module 200 implemented by the micro processor can simultaneously output four PWM signals respectively to the first LED 120, the second LED 140, the third LED 160, and the fourth LED 180. A duty cycle of the first PWM signal is 0.3; the duty cycle of the second PWM signal is 0.5; the duty cycle of the third PWM signal is 0.5; the duty cycle of the fourth PWM signal is 0.9. In accordance with the control of the duty cycles of the PWM signals, the proportion of luminous energy of the first LED 120 can be 0.3, which is between 0.061 and 0.435. Similarly, the energy distribution of the luminous energy for the second LED 140 can be 0.5, which is between 0.124 and 0.925. The energy distribution of the luminous energy for the third LED 160 can be 0.5, which is between 0.220 and 1. The energy distribution of the luminous energy for the fourth LED 180 can be 0.9, which is between 0.755 and 1.

It is worth mentioning that the controls of the proportions of the luminous energy of the LEDs as well as the duty cycles of the PWM signals are based on that luminous intensities of the above-mentioned four LEDs are the same. Actually, the luminous intensity of each LED is not the same. Thus, the duty cycles of the PWM signals for the LEDs can be respectively adjusted, so that the energy distribution of the luminous energy for each LED can be located at desired ranges.

In summary, the criteria of the color temperatures can be achieved by only using the four LEDs with the specific wavelengths in the present invention. Moreover, the LEDs do not employ the phosphors, so the problem of the deterioration can be overcame. In addition, the eight light color temperatures defined by the ENERGY STAR can be dynamically adjusted to show through the driving module 200 controlling the energy proportions of the above-mentioned four LEDs, and the CRI of each light color is larger than 90. Besides, the illuminating light emitted from the lighting lamp of the present invention can be modulated to the high color temperatures of 9000K and 12000K. The two illuminating lights with the high color temperatures of 9000K and 12000K have functions of improving attention and alertness, and the lights can boost user's asleep spirit in the afternoon.

While the preferred embodiments of the present invention have been illustrated and described in detail, various modifications and alterations can be made by persons skilled in this art. The embodiment of the present invention, is therefore described in an illustrative but not restrictive sense.

What is claimed is:

1. A lighting lamp for emitting a plurality of lights with different color temperatures, the lighting lamp comprising:

a combination of light sources consisting essentially of:

a first LED whose main wavelength ranges from 447 nanometers to 463 nanometers;

a second LED whose main wavelength ranges from 520 nanometers to 540 nanometers;

a third LED whose main wavelength ranges from 588 nanometers to 605 nanometers; and a fourth LED whose main wavelength ranges from 623 nanometers to 670 nanometers; and a driving module electrically, coupled to the combination of the light sources, for driving the LEDs to illuminate and controlling energy distribution of luminous energy for the first, second, third and fourth LEDs;

wherein color rendering indexes of the lights emitted from the lighting lamp are larger than 90.

2. The lighting lamp of claim 1, wherein the color temperature comprises 2700K, 3000K, 3500K, 4000K, 4500K, 5000K, 5700K, 6500K, 9000K, and 12000K.

3. The lighting lamp of claim 2, wherein the energy distribution of the luminous energy for the first LED ranges from 0.061 to 1; the energy distribution of the luminous energy for the second LED ranges from 0.124 to 1; the energy distribution of the luminous energy for the third LED ranges from 0.220 to 1; the energy distribution of the luminous energy for the fourth LED ranges from 0.178 to 1.

4. The lighting lamp of claim 2, wherein while the light with color temperature of 2700K is emitted, the energy distribution of the luminous energy for the first LED ranges from 0.061 to 0.435; the energy distribution of the luminous energy for the second LED ranges from 0.124 to 0.925; the energy distribution of the luminous energy for the third LED ranges from 0.220 to 1; the energy distribution of the luminous energy for the fourth LED ranges from 0.755 to 1.

5. The lighting lamp of claim 2, wherein while the light with color temperature of 3000K is emitted, the energy distribution of the luminous energy for the first LED ranges from 0.087 to 0.569; the energy distribution of the luminous energy for the second LED ranges from 0.144 to 1; the energy distribution of the luminous energy for the third LED ranges from 0.229 to 1; the energy distribution of the luminous energy for the fourth LED ranges from 0.672 to 1.

6. The lighting lamp of claim 2, wherein while the light with color temperature of 3500K is emitted, the energy distribution of the luminous energy for the first LED ranges from 0.076 to 0.799; the energy distribution of the luminous energy for the second LED ranges from 0.132 to 1; the energy distribution of the luminous energy for the third LED ranges from 0.229 to 1; the energy distribution of the luminous energy for the fourth LED ranges from 0.560 to 1.

7. The lighting lamp of claim 2, wherein while the light with color temperature of 4000K is emitted, the energy distribution of the luminous energy for the first LED ranges from 0.193 to 0.977; the energy distribution of the luminous energy for the second LED ranges from 0.212 to 1; the energy distribution of the luminous energy for the third LED ranges from 0.252 to 1; the energy distribution of the luminous energy for the fourth LED ranges from 0.488 to 1.

8. The lighting lamp of claim 2, wherein while the light with color temperature of 4500K is emitted, the energy distribution of the luminous energy for the first LED ranges from 0.253 to 1; the energy distribution of the luminous energy for the second LED ranges from 0.244 to 1; the energy distribution of the luminous energy for the third LED ranges from 0.263 to 1; the energy distribution of the luminous energy for the fourth LED ranges from 0.424 to 1.

9. The lighting lamp of claim 2, wherein while the light with color temperature of 5000K is emitted, the energy distribution of the luminous energy for the first LED ranges from 0.314 to 1; the energy distribution of the luminous energy for the second LED ranges from 0.267 to 1; the energy distribution of the luminous energy for the third LED ranges from 0.268 to 1; the energy distribution of the luminous energy for the fourth LED ranges from 0.391 to 1.

10. The lighting lamp of claim 2, wherein while the light with color temperature of 5700K is emitted, the energy distribution of the luminous energy for the first LED ranges from 0.384 to 1; the energy distribution of the luminous energy for the second LED ranges from 0.306 to 1; the energy distribution of the luminous energy for the third LED ranges from 0.279 to 0.949; the energy distribution of the luminous energy for the fourth LED ranges from 0.356 to 1.

11. The lighting lamp of claim 2, wherein while the light with color temperature of 6500K is emitted, the energy distribution of the luminous energy for the first LED ranges from 0.459 to 1; the energy distribution of the luminous energy for the second LED ranges from 0.333 to 1; the energy distribution of the luminous energy for the third LED ranges from 0.284 to 0.885; the energy distribution of the luminous energy for the fourth LED ranges from 0.313 to 1.

12. The lighting lamp of claim 2, wherein while the light with color temperature of 9000K is emitted, the energy distribution of the luminous energy for the first LED ranges from 0.693 to 1; the energy distribution of the luminous energy for the second LED ranges from 0.434 to 0.888; the energy distribution of the luminous energy for the third LED ranges from 0.263 to 0.644; the energy distribution of the luminous energy for the fourth LED ranges from 0.205 to 1.

13. The lighting lamp of claim 2, wherein while the light with color temperature of 12000K is emitted, the energy distribution of the luminous energy for the first LED ranges from 0.759 to 1; the energy distribution of the luminous energy for the second LED ranges from 0.455 to 0.828; the energy distribution of the luminous energy for the third LED ranges from 0.239 to 0.579; the energy distribution of the luminous energy for the fourth LED ranges from 0.178 to 1.

14. The lighting lamp of claim 1, wherein the driving module is a micro processor, and the micro processor synchronously outputs four pulse width modulation signals to the LEDs, respectively.

* * * * *